United States Patent [19]

Körling et al.

[11] Patent Number: 4,967,444

[45] Date of Patent: Nov. 6, 1990

[54] DEVICE FOR DAMPING THE CLOSING MOVEMENT OF A DUAL DOOR SPRING-LOADED OR CLOSURE AND CLOSURE CONTROL THEREFOR

[75] Inventors: Werner Körling; Franz Kraft, both of Menden, Fed. Rep. of Germany

[73] Assignee: Geze GmbH, Leonberg, Fed. Rep. of Germany

[21] Appl. No.: 466,717

[22] Filed: Feb. 15, 1983

[51] Int. Cl.[5] ..... E05F 3/12

[52] U.S. Cl. ..... 16/58; 16/62; 16/64; 16/84; 16/DIG. 10; 16/DIG. 17; 16/DIG. 21; 16/48.5; 188/292; 188/295

[58] Field of Search ..... 16/84, 274, 277, 298, 16/354, DIG. 7, DIG. 9, FIG. 10, DIG. 17, FIG. 21, 48.5, 58, 62, 64; 188/292, 295

[56] References Cited

U.S. PATENT DOCUMENTS 1,826,553 10/1931 Lasier ..... 16/DIG. 17 X 2,098,501 11/1937 Lasier ..... 16/84

4,073,033 2/1978 Lexnas ..... 16/52

4,267,619 5/1981 Suska ..... 16/48.5

*Primary Examiner*—Nicholas P. Godici

*Assistant Examiner*—Edward A. Brown

[57] ABSTRACT

A double-winged door spring is biased for closing with a mechanism for damping of the closure movement and includes a closure sequence control, particularly of a fire-resistant door, in which the damping of the movable door portion is accomplished through a hydraulic damping element with throttled overflow. The hydraulic damping element includes two oppositely controlled pressure chambers defined by a double-acting piston and a valve disposed in the overflow conduit connecting the two pressure chambers, the valve being actuated directly or indirectly through the stationary door portion. By the valve being disposed in the overflow conduit, actuation of the movable door portion can be inhibited until the stationary door portion is closed.

2 Claims, 2 Drawing Sheets

Figure 1:
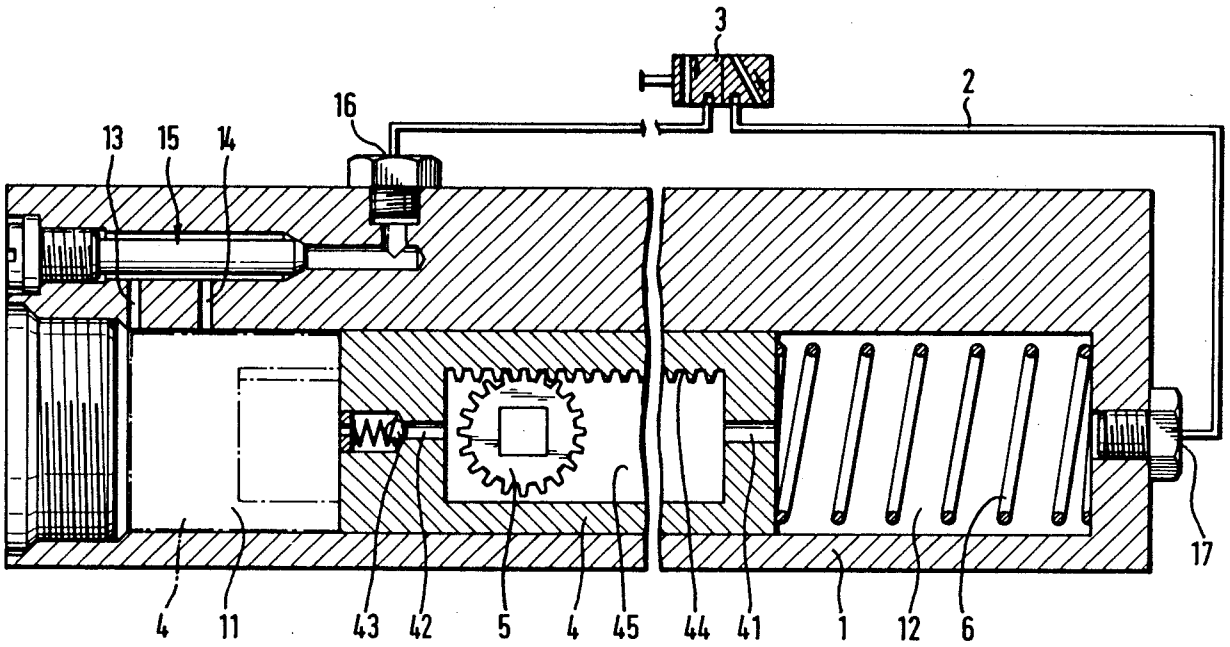

DEVICE FOR DAMPING THE CLOSING MOVEMENT OF A DUAL DOOR SPRING-LOADED OR CLOSURE AND CLOSURE CONTROL THEREFOR

SUMMARY

In a double-winged door spring-loaded in a closure direction with a mechanism for damping of the closure movement and a closure sequence control, particularly of a fire-resistant door, in which the damping of the movable door portion is accomplished through a hydraulic damping element with throttled overflow of two oppositely controlled pressure chambers through a double-acting piston, there is disposed a valve in the overflow conduit passing from one pressure chamber to another pressure chamber, the valve being actuatable directly or indirectly through the stationary door portion.

Here there is used the already available and known damping element of the movable door portion, for example an automatic door closer, for the necessary closure sequence control. By the valve being disposed in the overflow conduit, actuation of the movable door portion can be inhibited in a simple manner until the stationary door portion is closed. In this manner one ensures that the movable door portion cannot be closed prior to the stationary door portion.

The invention relates to a double-winged door with a closure sequence control, particularly for a fire-resistant door.

Both the stationary wing, as well as the movable wing of a fire-resistant door are equipped, according to the appropriate regulations, with door closers, which have for their purpose the automatic closure of the door wings. It is known to equip the movable door portion with a hydraulic damping element, which damps the closure movement of the door half which is spring-loaded in a closure direction within a certain angular closure region. This damping is inhibited shortly prior to termination of the closure movement. In these double-winged fire-resistant doors there is further required a closure sequence, by means of which one ensures that the movable door portion, which, as a rule receives the lock and the handle of the door, is only closed when the so-called stationary door wing is closed. For such a closure sequence control there are known, for example from DE-OS2918730 several mechanical arrangements with expensive leverages and spring mechanisms.

So-called hydraulic toothed-rack type closers are used for damping of the closure movement of a fire-resistant door. The cylindrical-type housing of such a damping element is usually secured to the frame of the door. Within the interior thereof a double-acting piston, which separates two pressure chambers from one another is displaceable against a spring pressure. The movable door wing is connected to the pistons through a rack and pinion gear and an appropriate lever. During the opening movement of the movable door wing the piston is displaced against the compression spring and the hydraulic pressure medium streams from one pressure chamber decreasing in size through an overflow bore in the piston with a check valve into the other chamber which is increasing in size. During closure of the door the check valve inhibits flowback of the pressure medium through the piston. Through radial control bores in the cylinder the pressure medium passes to a throttled overflow conduit, which leads to the other pressure chamber. As a result of the throttling the closure movement is damped or braked.

It is an object of the invention to simplify the closure sequence control of a double-winged fire-resistant door with a mechanism for damping the closure movement.

To solve this inventive task the mechanism of the initially described type has disposed in the overflow conduit from one pressure chamber to another pressure chamber a control valve for closure sequence control which is actuated directly or indirectly through the stationary door wing.

In a preferred embodiment of the invention one pressure chamber is connected to the other pressure chamber through an exterior overflow conduit.

The invention makes use of the available damping element of the movable door wing known per se for the necessary closure sequence control. By the control valve being disposed in the overflow conduit, actuation of the movable door wing can be inhibited in a simple manner, until the stationary door wing is closed.

By means of an illustrated embodiment of a toothed-rack closure, the inventive closure sequence control of a double-winged door will be explained further as follows.

Figure 2:
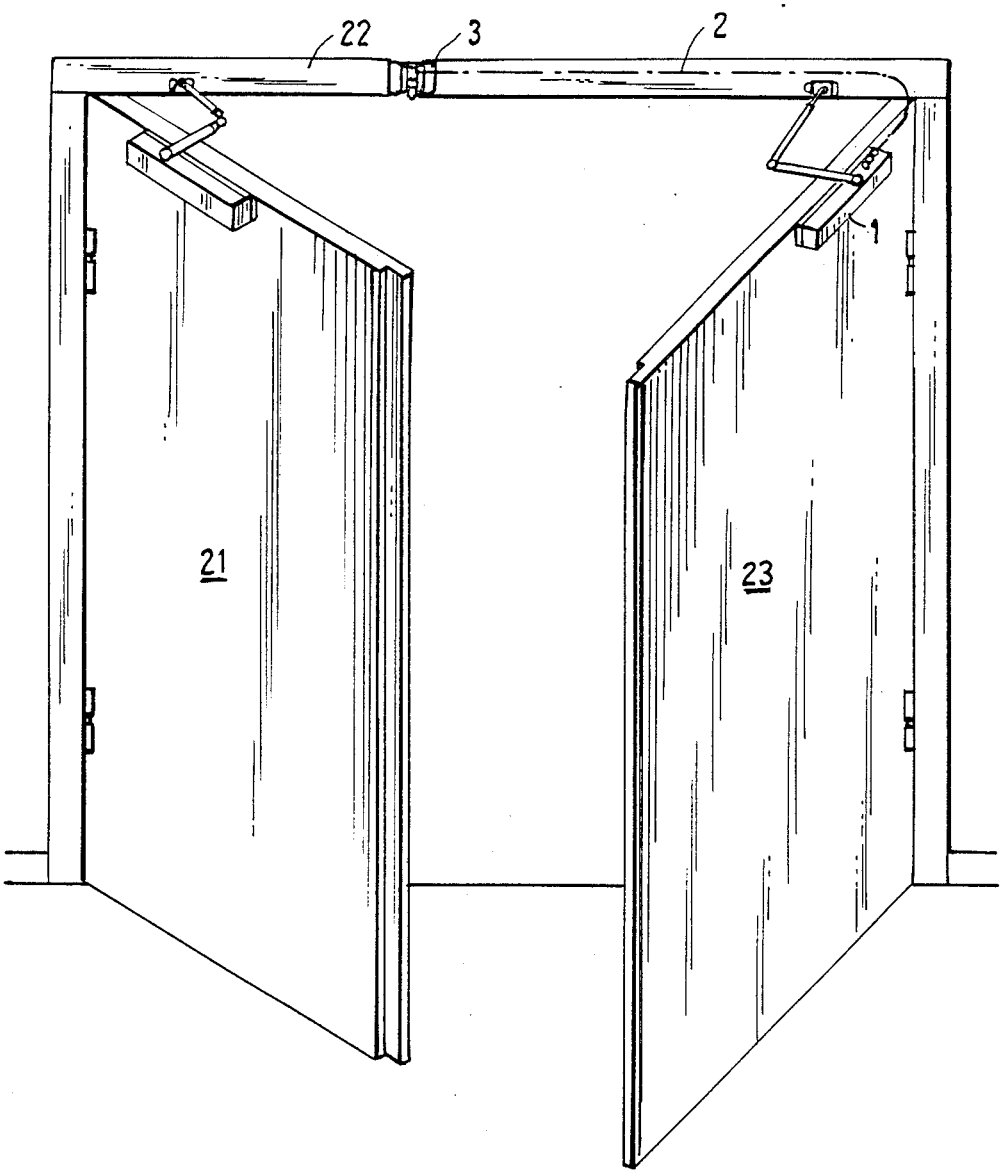

In the drawing:

FIG. 1 shows a cross-section through the cylindrical-type housing of a hydraulic toothed-rack closure with a valve-controlled overflow conduit; and FIG. 2 shows a double-winged door to which the closure sequence control device has been applied.

The control valve denoted with a reference numeral 3 is attached either directly to a normally stationary door wing 21, or to the corresponding frame 22 of a double-winged fire-resistant door. But an indirect actuation of such a control valve can also be provided. In such a case there must be disposed at the appropriate location a corresponding switch or the like.

The illustrated hydraulic toothed-rack closer consists of a cylindrical-type housing 1, in which a double-acting piston 4 is displaceable, and which separates two pressure chambers 11 and 12 from one another. This piston 4 is displaceable through a rack and pinion gear, which is connected to the movable door wing 23 of a fire-resistant door. The cylindrically-shaped toothed wheel denoted with the reference numeral 5 engages the recess 45 of piston 4 through the housing from the exterior. The recess is equipped with a toothed rack 44.

During the opening movement of the door wing 23 piston 4 is displaced against the pressure of the closure spring 6. This movement of piston 4 reducers the size of pressure chamber 12. The displaced pressure medium, for example hydraulic oil, streams unhindered through the bores 41 and 42 of piston 4 into pressure chamber 411.

In the corresponding phase of the closure movement of the movable door wing 23, piston 4 is moved in a reverse direction. The pressure of the oil in the pressure chamber 11 closes the check valve 43 in bore 42. The pressure medium can only stream through the radial bores 13 and 14 to throttle valve 15. When the control valve 3 in the overflow conduit 2 is open, which is in communication with the pressure chamber 11 through the bore 16, and is in communication with the pressure chamber 12 through the bore 17, the pressure medium can be throttled, namely it may overflow while being damped or braked.

Advantageously control valve 3, which is actuated through the stationary door wing 21, is disposed in an exteriorly arranged overflow conduit. But it is also possible to dispose this valve in housing 1 in the overflow conduit, and to use only a single control element, on the stationary wing, for example one with electromagnetic actuation. Control elements of a pneumatic or also of an electromagnetic type can be provided in lieu of a hydraulic valve.

The inventive principle may also be utilized in other damping elements for fire-resistant doors, as the actuating freedom of the damping element is only to be controlled through the stationary door wing.

We claim:

1. A device for damping and regulating a closure sequence during a spring biased closure movement of a double-winged door, said double-winged door including a normally stationary door wing, and a movable door wing, said device comprising: a housing, a longitudinal chamber formed in said housing, a double-acting piston movable within said chamber defining first and second pressure chambers therein, said chambers adapted to receive hydraulic fluid herein, gear means operated by said piston and connected with said movable door wing to control the closure movement thereof, one way valve means for permitting the hydraulic fluid to pass between said first and second pressure chambers substantially unimpeded during the opening of said movable door wing, an overflow conduit communicating between said first and second pressure chambers, and a closure sequence control means for preventing initiation of closure of said movable door wing until the stationary door wing is closed, the closure sequence control means including a two-position control valve fluidly interposed in the overflow conduit and having fluid flow blocking means and fluid flow permitting means, said control means further including a valve position control means for moving said control valve from a first position having said fluid flow blocking means inserted into said overflow conduit and preventing fluid from flowing from said frist pressure chamber to said second pressure chamber to a second position having said fluid flow permitting means inserted into said overflow conduit and permitting fluid flow from said first pressure chamber to said second pressure chamber, said position control means including a sensor means for sensing when said stationary door wing is closed and for activating said valve position control means, fluid communication between said first and said second pressure chambers being only via said overflow conduit on closing said movable door wing whereby said closure sequence control means is in total control of such closing.

2. A device as defined in claim 1 wherein said overflow conduit is disposed external to said housing.

* * * * *

UNITED STATES PATENT AND TRADEMARK OFFICE

CERTIFICATE OF CORRECTION

PATENT NO. : 4,967,444

DATED : November 6, 1990

INVENTOR(S) : Werner Korling

It is certified that error appears in the above-identified patent and that said Letters Patent is hereby corrected as shown below:

ON THE TITLE PAGE: Title should read;

[54] DEVICE FOR DAMPING THE CLOSING MOVEMENT OF A DUAL DOOR SPRING-LOADED FOR CLOSURE AND CLOSURE CONTROL THEREFOR

Signed and Sealed this

Twenty-fourth Day of November, 1992

*Attest:*

DOUGLAS B. COMER

*Attesting Officer*

*Acting Commissioner of Patents and Trademarks*